US008511966B2

(12) United States Patent
Stähle

(10) Patent No.: US 8,511,966 B2
(45) Date of Patent: Aug. 20, 2013

(54) PUMP ROTOR AND PUMP COMPRISING A PUMP ROTOR OF SAID TYPE

(75) Inventor: Carl Stähle, Neunkirch (CH)

(73) Assignee: Frideco AG, Neunkirch (CH)

( * ) Notice: Subject to any disclaimer, the term of this patent is extended or adjusted under 35 U.S.C. 154(b) by 540 days.

(21) Appl. No.: 12/673,756

(22) PCT Filed: Aug. 18, 2008

(86) PCT No.: PCT/EP2008/060814
§ 371 (c)(1),
(2), (4) Date: Feb. 16, 2010

(87) PCT Pub. No.: WO2009/022019
PCT Pub. Date: Feb. 19, 2009

(65) Prior Publication Data

US 2010/0215504 A1 Aug. 26, 2010

(30) Foreign Application Priority Data

Aug. 16, 2007 (EP) ..... 07114479

(51) Int. Cl.
*F04D 1/04* (2006.01)

(52) U.S. Cl.
USPC ..... 415/72; 415/71; 416/204 R

(58) Field of Classification Search
USPC ..... 415/72, 121.1; 416/176, 177, 188, 416/183, 185, 186 R
See application file for complete search history.

(56) References Cited

U.S. PATENT DOCUMENTS 1,763,595 A * 6/1930 Paatsch ..... 415/196
3,692,422 A * 9/1972 Girardier ..... 415/121.1

(Continued)

FOREIGN PATENT DOCUMENTS

CH 662864 10/1987
DE 2442446 A1 5/1974

(Continued)

OTHER PUBLICATIONS

International Search Report for International Application No. PCT/EP2008/060814 dated Dec. 17, 2008.

(Continued)

*Primary Examiner* — Nathaniel Wiehe
*Assistant Examiner* — Aaron Jagoda
(74) *Attorney, Agent, or Firm* — Pearl Cohen Zedek Latzer, LLP

(57) ABSTRACT

The pump rotor (1) comprises a first blade (3), wherein the first blade (3) comprises a first helical-gear blade part (3*a*) and, adjoining the latter, a first centrifugal-wheel blade part (3*b*), and said pump rotor (1) comprises a hub (2) with a rotational axis (D), wherein the centrifugal-wheel blade part (3*b*) is fixedly connected to the hub (2), wherein at least one second blade (4) is provided which comprises a second helical-gear blade part (4*a*) and, adjoining the latter, a second centrifugal-wheel blade part (4*b*), wherein the first and the second blades (3,4) have in each case one outer edge (3*c*,4*c*), wherein a connecting means (5) connects the first and second blades (3,4) to one another in the region of the outer edge (3*c*,4*c*), and wherein the second centrifugal-wheel blade part (4*b*) is arranged so as to run relative to the hub (2) in such a way that an opening (6) which runs continuously in the rotational direction (D1) is formed between said second centrifugal-wheel blade part (4*b*) and hub (2), since the second centrifugal-wheel blade part (4*b*) is not directly connected to the hub (2).

12 Claims, 5 Drawing Sheets

(56) References Cited

U.S. PATENT DOCUMENTS

| | | | | |
|---|---|---|---|---|
| 4,347,035 | A * | 8/1982 | Stahle | 415/121.1 |
| 4,648,796 | A * | 3/1987 | Maghenzani | 415/218.1 |
| 6,158,959 | A | 12/2000 | Arbeus | |
| 6,343,909 | B1 * | 2/2002 | Springer et al. | 415/71 |
| 6,390,768 | B1 * | 5/2002 | Muhs et al. | 415/71 |
| 2009/0169374 | A1 * | 7/2009 | Ilves et al. | 415/206 |

FOREIGN PATENT DOCUMENTS

| | | | |
|---|---|---|---|
| DE | 2442446 | | 3/1976 |
| EP | 0854294 | | 7/1998 |
| EP | 1811184 | | 7/2007 |
| RU | 2224138 | | 3/1976 |
| SU | 623004 | | 7/1978 |
| SU | 1642076 | | 4/1991 |
| WO | WO 2007079890 | A1 * | 7/2007 |

OTHER PUBLICATIONS

Office Action to Russian Application No. 2010109741/06 mailed Jul. 23, 2012.

* cited by examiner

PUMP ROTOR AND PUMP COMPRISING A PUMP ROTOR OF SAID TYPE

CROSS-REFERENCE TO RELATED APPLICATIONS

This application is a National Phase Application of PCT International Application No. PCT/EP2008/060814, International Filing Date Aug. 18, 2008, claiming priority of European Patent Application No. 07114479.4, filed Aug. 16, 2007, which is hereby incorporated in its entirety.

DESCRIPTION

The invention relates to a pump rotor in accordance with the preamble of claim 1. The invention further relates to a pump including the pump rotor.

PRIOR ART

Document CH 662 864 discloses a centrifugal pump having a helical centrifugal wheel of an open design. This pump rotor or the centrifugal wheel pump including such a pump rotor has the disadvantages that the specific speed of rotation is limited and that pulsation and/or vibration can occur during operation.

Document U.S. Pat. No. 6,158,959 discloses a centrifugal pump having a rotor including two vanes. This pump rotor or the centrifugal wheel pump including such a pump rotor has the disadvantage that it tends to clog and therefore has a low efficiency when waste water is conveyed with this centrifugal wheel pump.

Document EP 1 811 184 A1 discloses a centrifugal pump having a rotor including at least two vanes which are arranged between two cover plates spaced apart from one another in the axial direction. This centrifugal pump has the disadvantages that it has a poor efficiency and that contaminants can accumulate.

Waste water contains a large number of different types of contaminants such as plastic material, sanitary products, textiles, etc. Larger problems in particular occur in connection with rags and the like since they catch at the front edges of the vanes and wrap around the rotor hub. Such occurrences result in increased service intervals, reduced efficiency and even pump failures.

REPRESENTATION OF THE INVENTION

It is the object of the invention to form a pump rotor and a pump including such a pump rotor which are suitable for the conveying of waste water or other liquids containing solids, which can be operated reliably and with low maintenance and which can have an increased conveying rate.

This object is satisfied by a pump rotor having the features of claim 1. Dependent claims 2 to 11 relate to further, advantageously designed pump rotors. The object is further satisfied by a pump, in particular a centrifugal wheel pump or an axial flow pump, having the pump rotor in accordance with the invention.

The object is in particular satisfied by a pump rotor including a first vane, wherein the first vane includes a first helical wheel vane part and a first centrifugal wheel vane part adjoining it as well as including a hub having an axis of rotation, wherein the first centrifugal wheel vane part is fixedly connected to the hub, wherein at least one second vane is provided which includes a second helical wheel vane part and a second centrifugal wheel vane part adjoining it, wherein the first and second vanes each have an outer edge, wherein a connection means connects the first and second vanes to one another in the region of the outer edge and wherein the hub forms a frustoconical or disk-shaped base part which extends along a pitch angle in the direction of rotation D1, that the first centrifugal wheel vane part 3*b* is fixedly connected to the base part 3*e* and that the second centrifugal wheel vane part 4*b* is arranged extending with respect to the hub 2 such that a throughgoing gap extending in the direction of rotation is formed between the second centrifugal wheel vane part 4*b* and the hub 2 in the direction of extent of the base part 3*e* because the second centrifugal wheel vane part is not directly connected to the hub. The pump rotor in accordance with the invention is thus open toward the bottom and has the gap extending in the direction of rotation there. Thanks to this gap, the surface disposed beneath it is constantly cleaned due to the rotation of the pump rotor. This gap therefore also prevents deposits.

In a particularly advantageous embodiment, the connection means is designed as a rotor cover which extends concentrically to the axis of rotation and which is fixedly connected to the outer edges of the first and second vanes. The rotor cover is preferably designed in frustoconical form, having a circular inlet opening which extends concentrically to the axis of rotation and through which the total liquid to be conveyed flows to reach the first and second vanes.

In a particularly advantageous embodiment, the first and second centrifugal wheel vane parts have the same length in the longitudinal direction of the axis of rotation D. In a particularly advantageous embodiment, the length is selected such that a small gap results between a pump housing part and the second centrifugal wheel vane part, which substantially improves the efficiency of the pump.

The pump rotor in accordance with the invention has the advantage that it has a throughgoing gap extending in the direction of rotation between the hub and the second vane because the second vane is not directly connected to the hub. The second vane is fixedly connected to the first vane via the connection means and the first vane is connected to the hub. This throughgoing gap extending between the hub and the second vane has the advantage that contaminants such as rags cannot be deposited or catch anywhere. The through passage formed within the pump rotor for the fluid to be conveyed is preferably designed such that it does not have any webs, protuberances or means formed in any other manner at which contaminants such as rags could collect or adhere. The pump in accordance with the invention is thus in particular also suitable for the conveying of waste water which contains solid contaminants, in particular also textiles, rags, etc. The pump is in particular suitable for the conveying of municipal waste water as wall as of liquids occurring in industrial, chemical and urban applications.

A pump including the pump wheel in accordance with the invention having at least two vanes in addition has the advantages that the pump has an increased conveying rate with the same pump wheel size or with the same pump size since the pump can have two or even more vanes. The pump can additionally have a higher efficiency. In addition, the pump has reduced pulsation and reduced vibration. The pump wheel in accordance with the invention can in addition be balanced more easily, can be trimmed more easily and is easier to machine. In addition, the pump wheel is less prone to wear.

A pump including the pump wheel in accordance with the invention can thus be operated substantially more reliably, with lower maintenance and more cost-effectively when the pump is used for the conveying of waste water or other liquids containing solids.

BRIEF DESCRIPTION OF THE DRAWINGS

The drawings used to illustrate the embodiments show.

Generally, the same parts are provided with the same reference numerals in the drawings.

WAYS OF PERFORMING THE INVENTION

Figure 1:
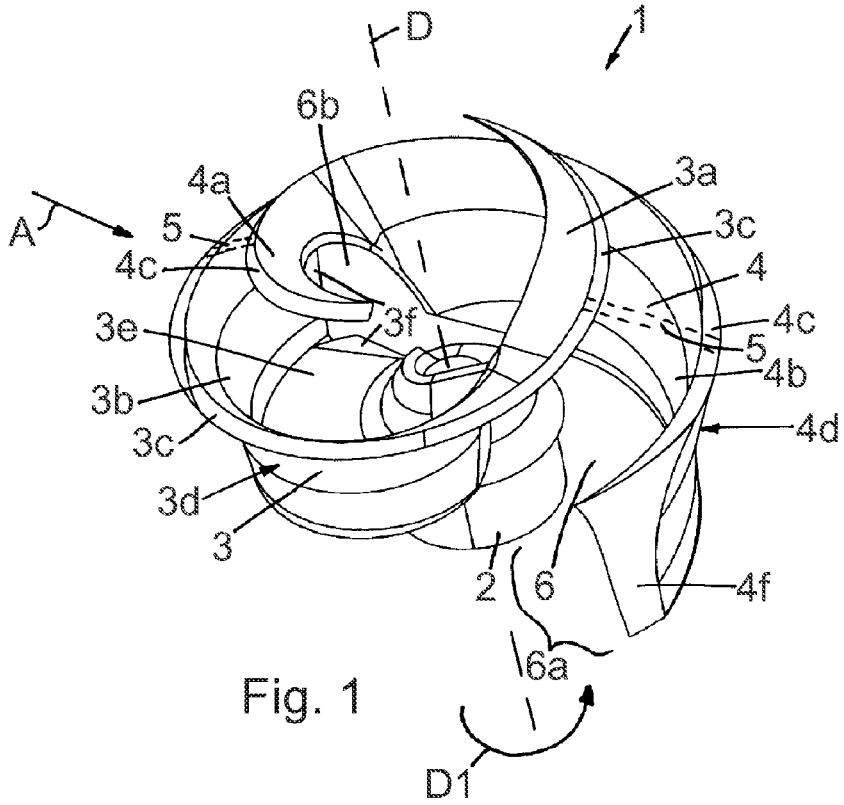
FIG. 1 a perspective view of an embodiment of a pump rotor having connection means only shown symbolically.
Figure 5:
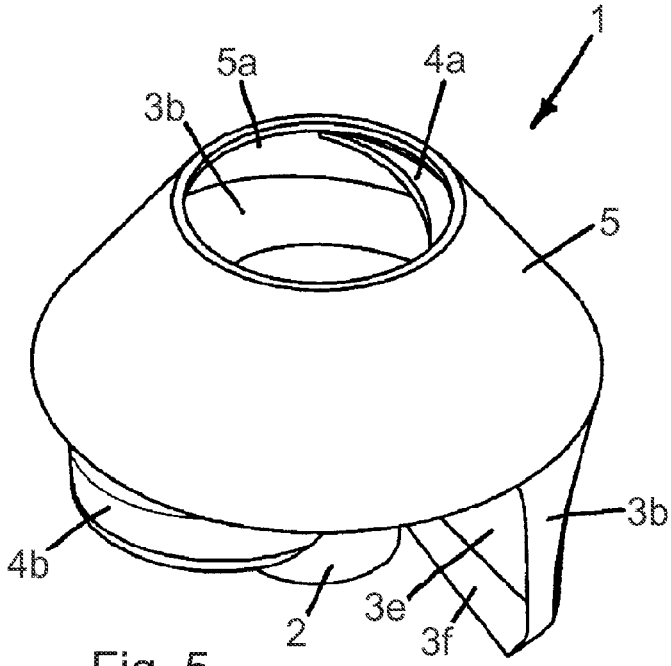
FIG. 5 a perspective view of a pump rotor with rotor cover.

FIG. 1 shows a pump rotor 1 rotatable about an axis of rotation D and including a first vane 3 which is fixedly connected to the hub 2 and including a second vane 4 which is connected to the first vane 3 via connection means 5 so that no direct connection is required between the second vane 4 and the hub 2 and a gap 6 or opening 6 extending in the direction of rotation D1 is formed between the second vane 4 and the hub 2. Gap 6 is understood here as an opening, in particular a gap-shaped opening. The connection means 5 is only indicated schematically in FIG. 1 so that the arrangement of the first and second vanes 3, 4 is clearly visible. The connection means 5 is preferably arranged such that it mutually fixedly connects the outer edges 3*c*, 4*c* of the first and second vanes 3, 4. The connection means 5 can be designed in a plurality of possibilities, for example, as shown in bar shape, partially areally or, as shown in FIG. 5, as a whole cover. The first vane 3 includes a first helical wheel vane part 3*a* which merges into a first centrifugal wheel vane part 3*b*. The first centrifugal wheel vane part 3*b* has a pressure-side vane flank 3*d*. The first centrifugal wheel vane part 3*b* is fixedly connected to the hub 2 via a base part 3*e*. The base part 3*e* extends along a pitch angle in the action of rotation D1. The base part 3*e* could preferably be designed as frustoconical or in disk-shape along the pitch angle. The second centrifugal wheel vane part 4*b* is arranged extending with respect to the hub 2 such that a throughgoing gap 6 extending in the direction of rotation D1 is formed between the second centrifugal wheel vane part 4*b* and the hub 2 because the second centrifugal wheel vane part 4*b* is not directly connected to the hub 2. The pump rotor 1 is thus open toward the bottom due to the gap 6. The base part 3*e* has an obliquely extending edge 3*f*. In addition, the first centrifugal wheel vane part 3*b* has an edge 3*f* at the end disposed opposite the first helical wheel vane part 3*a*. The first vane 3 has an outer edge 3*c* at its end face. The second vane 4 includes a second helical wheel vane part 4*a* which merges into a second centrifugal wheel vane part 4*b*. The second centrifugal wheel vane part 4*b* has a pressure-side vane flank 4*d* and ends in an edge 4*f*. The second vane 4 has an outer edge 4*c* at its end face. The two vanes 3, 4 are fixedly connected to one another via a connection means 5 which is arranged in the region of the outer edges 3*c*, 4*c*, but are arranged mutually spaced apart so that gaps are formed, in particular the gap 6 extending in the direction of rotation D1 which forms an outlet in the direction of extent of the axis of rotation D, and the gaps or outlet openings 6*a* and 6*b* which substantially extend in the direction of extent of the axis of rotation D and which result between the first and second vanes 3, 4. The pump rotor 1 does not have any projecting edges or protuberances at which contaminants such as plastic material or textiles such as rags could be deposited or could catch. Such contaminants exit the pump rotor 1 via the gaps 6, 6*a*, 6*b*. In an advantageous embodiment, the pump rotor 1 has edges 3*f*, 4*f* which also serve to remove deposits at the inner walls of the pump housing by scraping movements or cutting movements. The area of a pump housing arranged beneath the base part 3*e* can thus in particular also be cleaned.

The embodiment shown only shows two vanes 3, 4. It is, however, also possible to form a pump rotor 1 having a plurality of vanes which are formed in accordance with the second vane 4, which are arranged following one another in the direction of rotation D1 and which are all fixedly connected to the first vane 3 via the connection means 5. The pump rotor 1 could thus, for example, have one first vane 3 and a plurality of second vanes 4, for example two, three, four, five, six or seven second vanes 4 which are arranged following one another in the direction of rotation D1.

As shown in FIG. 1, the first and second vanes 3, 4 have part sections which extend in an advantageous embodiment in the direction of rotation D1 and which extend mutually symmetrically with respect to the axis of rotation D. In FIG. 1, the first and second helical wheel vane parts 3*a*, 4*a* extend mutually symmetrically with respect to the axis of rotation D. In addition, the pressure-side vane flanks 3*d*, 4*d* extend mutually symmetrically with respect to the axis of rotation D in FIG. 1.

Figure 2:
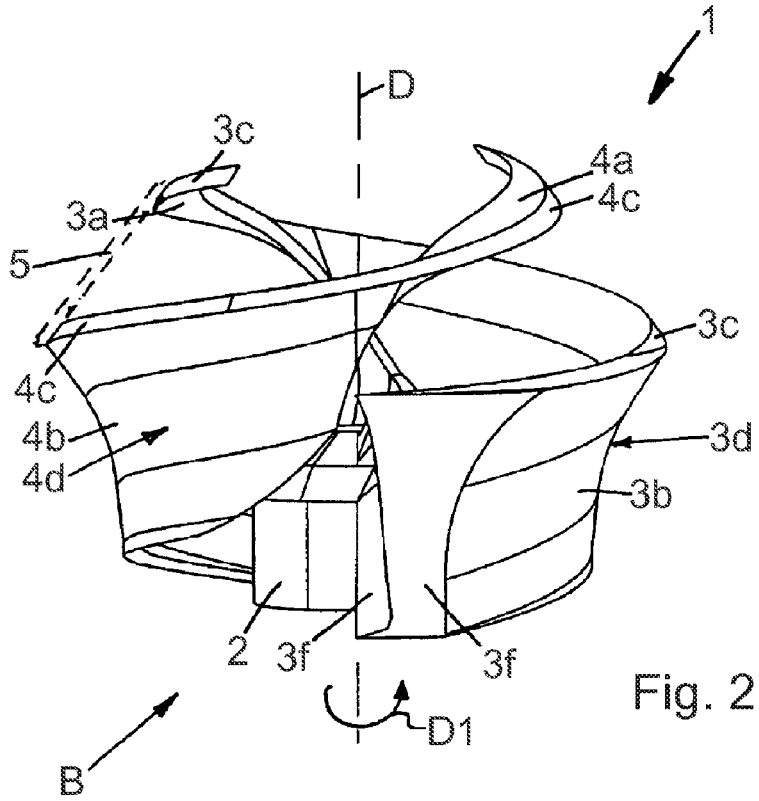
FIG. 2 a side view of the pump rotor shown in FIG. 1 from a side view direction A.

FIG. 2 shows the pump rotor 1 shown in FIG. 1 from the direction of view A. The connection means 5 is shown schematically. In a preferred embodiment, the connection means 5 is, as shown in FIG. 5, designed as a frustoconical body, having a circular inlet opening 5*a*, wherein the frustoconical body, as indicated in FIG. 2, contacts the outer edges 3*c*, 4*c* and is fixedly connected thereto. The connection means can also be designed as a disk in a direction radial to the axis of rotation D or as a cylindrical rotor in the axial direction D.

Figure 3:
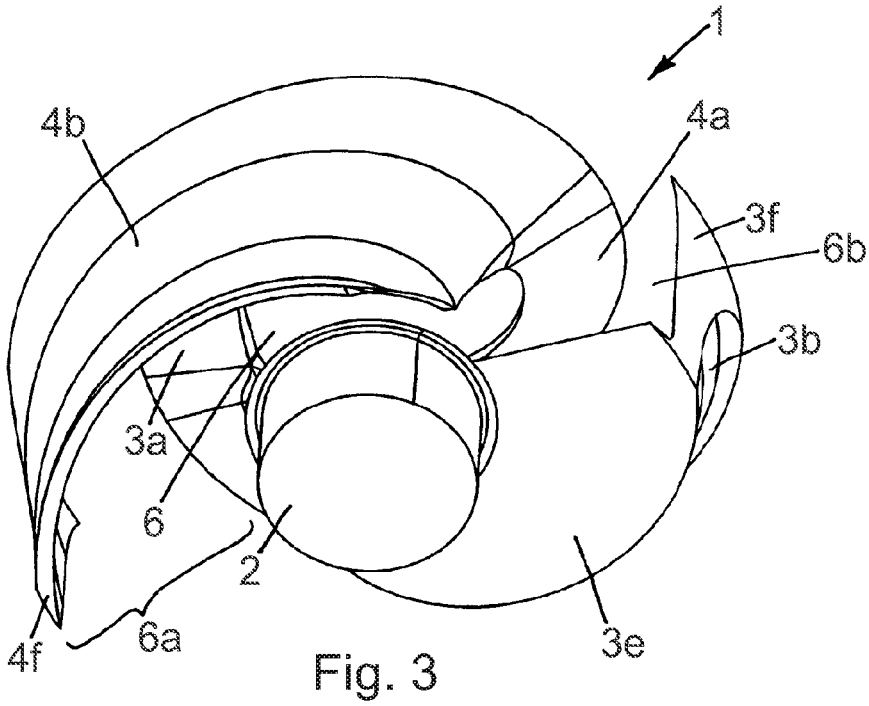
FIG. 3 a view from below of the pump rotor shown in FIGS. 1 and 2 from the direction of view B.

FIG. 3 shows the pump rotor 1 shown in FIGS. 1 and 2 from the direction of view B.

Figure 4:
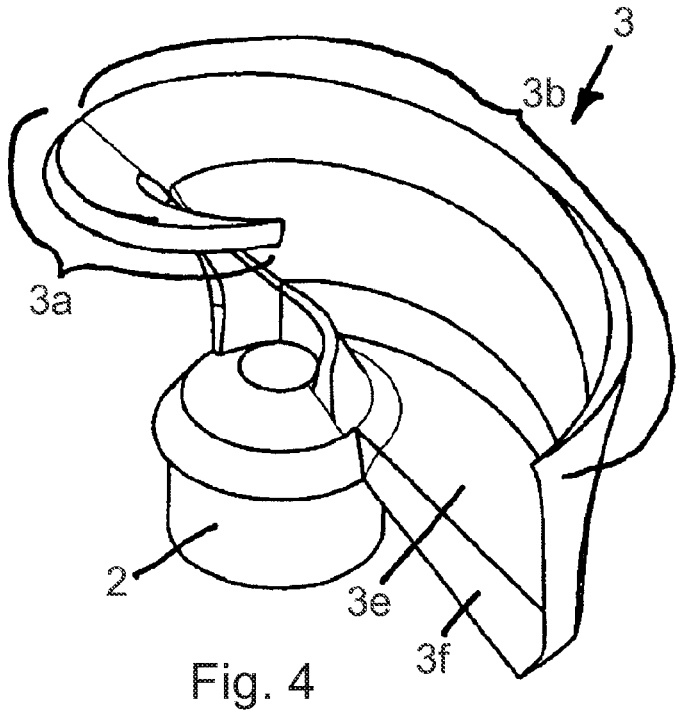
FIG. 4 a perspective view of the first vane.

FIG. 4 shows a perspective view of the first vane 3 which includes a first helical wheel vane part 3*a* and a first centrifugal wheel vane part 3*b*.

FIG. 5 shows the first vane 3 in the identical position as shown in FIG. 4, wherein the frustoconical connection part 5 is placed onto the first vane 3 and is fixedly connected thereto, and wherein the second vane 4 is fixedly connected to the connection part 5 so that the whole pump rotor 1 is formed.

Figure 6:
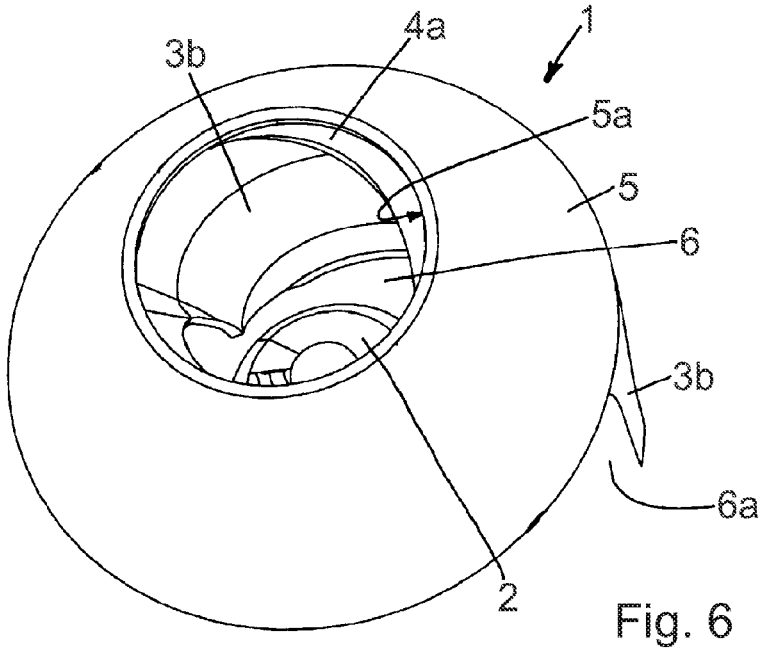
FIG. 6 the pump rotor shown in FIG. 5 from a slightly different perspective view.

FIG. 6 shows the pump rotor 1 shown in FIG. 5 from a slightly different perspective view. It can in particular also be recognized how the liquid flowing in via the opening 5*a*, where applicable with the also transported contaminants, is able to exit again without impediment either via the gap 6 or via the lateral openings 6*a*, 6*b*.

Figure 7:
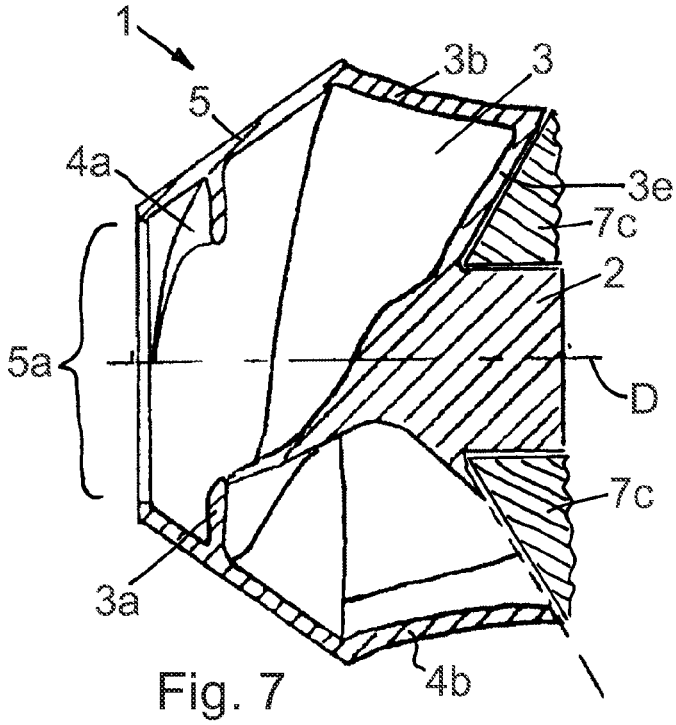
FIG. 7 a longitudinal section through the pump rotor shown in FIGS. 5 and 6.

FIG. 7 shows a longitudinal section through the pump rotor 1 shown in FIGS. 5 and 6. The connection means 5 designed as a rotor cover is connected in a fluid-tight manner to the first and second vanes 3, 4 so that the conveyed fluid enters into the pump rotor 1 via the circular opening 5*a* and exits it again via the gaps 6, 6*a*, 6*b*. The pump housing 7 has a housing wall 7*c* formed as a truncated cone in an advantageous embodiment. In FIG. 7, the first and second centrifugal wheel vane parts 3*b*, 4*b* have approximately the same length in the longitudinal direction of the axis of rotation D so that only an extremely small gap is formed between the housing wall 7*c* and the second centrifugal wheel vane part 4*b* so that only a small quantity of fluid exits through this gap. This embodiment has the advantage that the pump rotor 1 has a high efficiency. The main quantity of the conveyed fluid will therefore exit through the gaps 6*a* and 6*b*. If a contaminant were to be deposited at the housing wall 7*c*, it would preferably be removed by the edge 3*f* of the base part 3*e* which moves along the housing wall 7*c*. Contaminant deposits are thus prevented or reliably removed, which ensures a reliable operation of the pump rotor.

Figure 8:
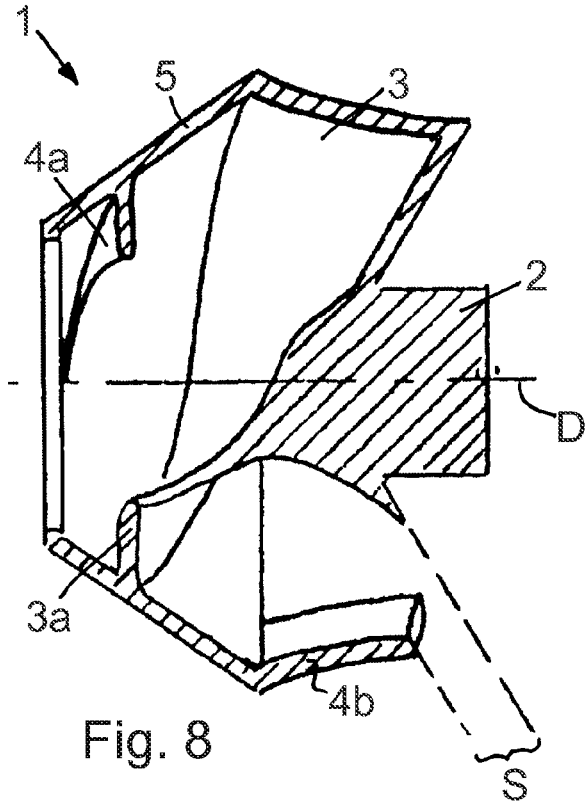
FIG. 8 a longitudinal section through a further pump rotor.

FIG. 8 shows a pump rotor 1 whose first and second centrifugal wheel vane parts 3*b*, 4*b* have different lengths in the longitudinal direction of the axis of rotation D so that a gap S is formed between the housing wall 7*c* and the second centrifugal wheel vane part 4*b* through which the liquid can flow. This gap S is preferably designed as small or as narrow as possible to keep a backflow of the liquid low.

Figure 9:
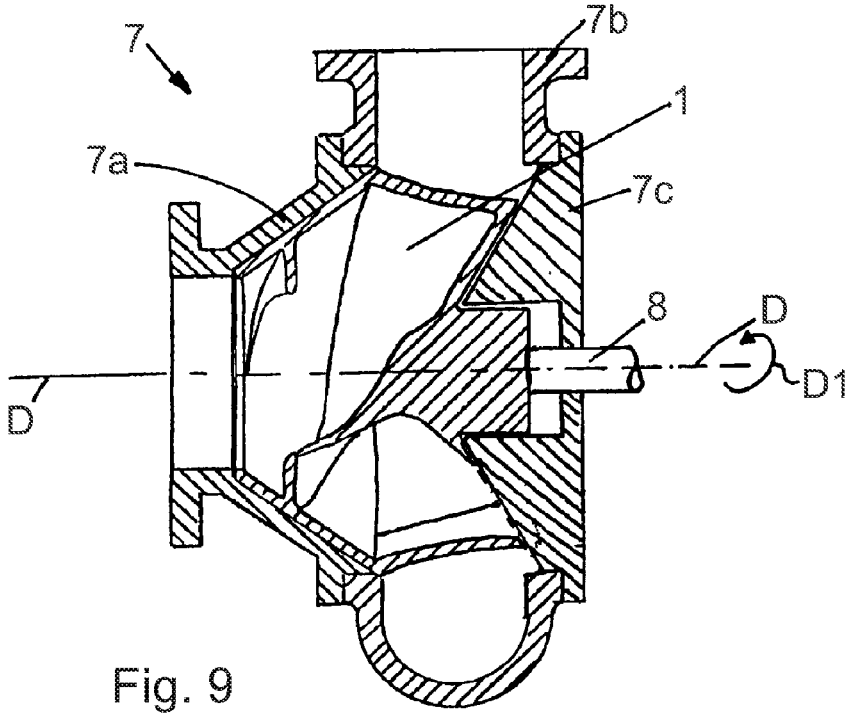
FIG. 9 a longitudinal section through a centrifugal wheel pump.

FIG. 9 shows a longitudinal section through a centrifugal pump 7 including pump housing parts 7*a*, 7*b*, 7*c* and the pump rotor 1 shown in FIG. 7. The pump housing could also be designed such that it forms, in combination with the pump rotor 1 arranged therein, an axial pump in that the axial pump has, instead of the radial outlet, an outlet extending in the direction of extent of the axis of rotation D.

The invention claimed is:

1. A pump rotor comprising:

a first vane, wherein the first vane includes a first helical wheel vane part and a first centrifugal wheel vane part adjoining said first helical wheel vane part, a hub having an axis of rotation, wherein the first centrifugal wheel vane part is fixedly connected to the hub and rotates thereabout in a direction of rotation, and at least one second vane comprising a second helical wheel vane part and a second centrifugal vane part adjoining said second helical wheel vane part, wherein the first and the second vanes each have an outer edge, and wherein a connection means connects the first and the second vanes to one another in the region of the outer edge, wherein the hub forms a frustoconical or disk-shaped base part which extends less than 360 degrees around the hub and along a pitch angle in the direction of rotation;

wherein the first centrifugal wheel vane part is fixedly connected to the base part; and wherein the second centrifugal wheel vane part is arranged at a distance away from the hub such that a throughgoing gap, extending around the hub in the direction of rotation, is formed between the second centrifugal wheel vane part and the hub because the second centrifugal wheel vane part is not directly connected to the hub.

2. A pump rotor in accordance with claim 1, wherein the base part has at least the same outer diameter as the first and second centrifugal wheel vane parts, and wherein the second centrifugal wheel vane part extends in the longitudinal direction of the axis of rotation such that said throughgoing gap extending in the longitudinal direction of the axis of rotation results between the base part and the second centrifugal wheel vane part.

3. A pump rotor in accordance with claim 1 wherein the first and second centrifugal wheel vane parts have the same length in the longitudinal direction of the axis of rotation.

4. A pump rotor in accordance with claim 1 wherein the second centrifugal wheel vane part is designed shorter in the longitudinal direction of the axis of rotation than the first centrifugal wheel vane part.

5. A pump rotor in accordance with claim 1, wherein the connection means is designed as a rotor cover which extends concentrically to the axis of rotation and which is fixedly connected to the outer edges of the first and second vanes, wherein the rotor cover is in particular designed as frustoconical, cylindrical or as a disk.

6. A pump rotor in accordance with claim 5, wherein the rotor cover has a circular opening which extends concentrically to the axis of rotation.

7. A pump rotor in accordance with claim 1, wherein the first and second vanes have pitch sections which extend in the direction of rotation and which extend mutually symmetrically with respect to the axis of rotation.

8. A pump rotor in accordance with claim 7, wherein the first and second helical wheel vane parts extend mutually symmetrically with respect to the axis of rotation.

9. A pump rotor in accordance with claim 7 wherein the first and second centrifugal wheel vane parts each have a pressure-side vane flank; and in that the pressure-side vane flanks extend mutually symmetrically with respect to the axis of rotation.

10. A pump rotor in accordance with claim 1, including a plurality of second vanes arranged spaced apart in the direction of rotation.

11. A pump comprising a pump rotor in accordance with claim 1.

12. The pump in accordance with claim 11, wherein said pump is a centrifugal pump or an axial flow pump.

* * * * *